United States Patent [19]

Devaney

[11] Patent Number: 4,574,168

[45] Date of Patent: Mar. 4, 1986

[54] MULTIPLE-STAGE INTEGRATING ACCELEROMETER

[75] Inventor: Howard F. Devaney, Cedar Crest, N. Mex.

[73] Assignee: The United States of America as represented by the United States Department of Energy, Washington, D.C.

[21] Appl. No.: 625,326

[22] Filed: Jun. 27, 1984

[51] Int. Cl.[4] ..... H01H 35/14; F42C 15/24

[52] U.S. Cl. ..... 200/61.53; 102/262

[58] Field of Search ..... 200/61.45 R, 61.53; 102/247, 262; 73/492, 516 R, 517 R, 514

[56] References Cited

U.S. PATENT DOCUMENTS

| | | | |
|---|---|---|---|
| 2,424,390 | 7/1947 | Ferris | 200/61.53 |
| 3,771,457 | 11/1973 | Buxton | 102/262 |
| 3,919,941 | 11/1975 | Breed et al. | 102/250 |
| 4,002,077 | 1/1977 | Taplin | 73/503 |
| 4,345,124 | 8/1982 | Abbin et al. | 200/61.53 |

*Primary Examiner*—Stewart J. Levy
*Assistant Examiner*—John E. Chapman, Jr.
*Attorney, Agent, or Firm*—James H. Chafin; Albert Sopp; Judson R. Hightower

[57] ABSTRACT

An accelerometer assembly is provided for use in activating a switch in response to multiple acceleration pulses in series. The accelerometer includes a housing forming a chamber. An inertial mass or piston is slidably disposed in the chamber and spring biased toward a first or reset position. A damping system is also provided to damp piston movement in response to first and subsequent acceleration pulses. Additionally, a cam, including a Z-shaped slot, and cooperating follower pin slidably received therein are mounted to the piston and the housing. The middle or cross-over leg of the Z-shaped slot cooperates with the follower pin to block or limit piston movement and prevent switch activation in response to a lone acceleration pulse. The switch of the assembly is only activated after two or more separate acceleration pulses are sensed and the piston reaches the end of the chamber opposite the reset position.

18 Claims, 4 Drawing Figures

MULTIPLE-STAGE INTEGRATING ACCELEROMETER

The U.S. government has rights to this invention pursuant to Contract No. DE-AC04-76DP00789 between the U.S. Department of Energy and At & T Technologies, Inc.

BACKGROUND OF THE INVENTION

This invention relates generally to integrating accelerometers and, more particularly, to an integrating accelerometer assembly requiring more than a single acceleration-time pulse before actuation occurs.

Integrating accelerometers, acceleration switches, and inertial devices are widely used to measure forces resulting from changes in velocity, and to actuate a switch or the like in response to sensing a predetermined acceleration pulse. Such devices include some type of sensing mass, such as a piston, suspended so as to be affected by acceleration forces; i.e. the piston moves and thereby serves to open or close an electrical switch or switches.

The device may be filled with a fluid for damping motion, or contain a mechanical escapement or other delay mechanism so as to prevent premature or accidental actuation of the switch. Thus, the prior art accelerometer has the capability of protecting against actuation in response to a false signal, such as a short duration, high g-force, vibration or shock. This arrangement protects against such inadvertent actions as dropping, or simply an accidental crash during transportation.

One possible use of such an accelerometer is in a rocket arming circuit. For obvious reasons of safety, it is desirable that such circuits of the rocket payload not be actuated until the rocket has experienced a normal launch environment. For example, the prior art devices have been successfully used in protecting single stage rocket systems from being prematurely armed. For additional safety, it is also desirable not to arm a rocket payload when the rocket, normally launched by multiple launch boosters or stages, experiences activation of only one of the launch stages, as might occur in an accidental launch. Present integrating accelerometers, such as shown in U.S. Pat. No. 3,919,941 to Breed et al and U.S. Pat. No. 4,345,124 to Abbin Jr. et al, clearly do not have this capability as pointed out above. These prior art devices when used in a multiple stage rocket would simply actuate if the magnitude of acceleration-time pulse of the first stage is of proper value and for sufficient length of time regardless of the proper ignition and operation of the following stages and generation of subsequent acceleration-time pulses.

Thus, a need is identified for an integrating accelerometer assembly that responds to multiple acceleration pulses applied in series. Such an accelerometer would provide greatly improved safety as, for example, in the event of inadvertent launch due to firing of any single stage of a multi-stage rocket.

SUMMARY OF THE INVENTION

Accordingly, it is a primary object of the present invention to provide an integrating accelerometer with multi-stage capability overcoming the above-described limitations and disadvantages of the prior art.

Another object of the present invention is to provide an integrating accelerometer for sensing or measuring the varying forces associated with multiple stage launch acceleration.

Another object of the present invention is to provide an integrating accelerometer for sensing or measuring multiple acceleration pulses acting in the same direction and with low or near zero acceleration phases between pulses.

A still additional object of the present invention is to provide an integrating accelerometer for sensing a significant reduction in acceleration following a predetermined minimum initial acceleration-time pulse or stage, such that the accelerometer remains in the unarmed or safe condition following that initial pulse.

Still another object of the present invention is to provide an improved integrating accelerometer that interrupts or blocks the arming function of a multiple-stage rocket if only a single acceleration-time pulse is sensed.

A further object of the present invention is to provide an integrating accelerometer for sensing the forces and times associated with a moving body, and, in particular, the forces of a second or third stage acceleration pulse and reliably actuating after such pulse.

An additional object is to provide an integrating multi-stage accelerometer having an improved bypass system for reducing fluid damping to provide more reliable transition between the stages.

Additional objects, advantages, and other novel features of the invention will be set forth in part in the description that follows and in part will become apparent to those skilled in the art upon examination of the following or may be learned with practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved accelerometer assembly including a switch is provided for responding to multiple acceleration pulses in series. The assembly includes a housing having first and second end portions forming a chamber. A movable mass, such as a piston, is provided within the chamber. The piston is maintained in or biased toward an initial or reset position adjacent the first end of the chamber by means of a spring. The movement of the piston is also damped by a fluid, such as silicone hydraulic fluid filling the chamber. A cam means and means for following the cam, such as a follower pin slidably received therein, are mounted to the piston and the housing. The cam means also includes means for blocking the movement of the piston temporarily after movement as a result of the initial acceleration pulse. During acceleration, the piston moves relative to the chamber in opposition to the spring. The blocking means of the cam and the follower pin cooperate to interrupt or limit the movement of the piston toward the second end of the chamber. Continued relative movement is made only in response to at least a second, separate acceleration pulse in series with the first pulse. Thus, the switch of the assembly is only activated after two or more separate pulses are sensed and the piston reaches the second end of the chamber.

In a preferred embodiment, the accelerometer may be operative to prevent certain arming circuits of a rocket payload from being activated, i.e. the payload is not armed unless the rocket has experienced a normal multi-stage launch environment. In doing this, the accelerometer of the invention provides greatly increased safety over prior accelerometers that activate in response to only a single pulse.

Preferably, the cam means includes a substantially Z-shaped slot. A first integration leg of the Z-shaped slot is substantially longitudinally aligned with the direction of acceleration so as to allow movement of the piston toward the second end of the chamber during an initial acceleration pulse. The Z-shaped slot also includes a second integration leg substantially longitudinally aligned with the direction of acceleration. This second integration leg allows further movement of the piston toward the second end of the chamber during a second acceleration pulse. Additionally, the Z-shaped slot includes a cross-over leg for connecting the first and second integration legs together. The cross-over leg has a portion which is transverse to the direction of acceleration so as to form the initial blocking means of the cam. It is this cross-over leg that blocks or limits the movement of the piston to prevent switch activation in response to any lone acceleration pulse such as may be experienced during an accidental launch of a multi-stage vehicle.

The blocking means or cross-over leg also includes a protruding lip slightly reverse angled with respect to the direction of acceleration so as to insure that piston movement, which is interrupted or limited after the first acceleration pulse, will not continue until the piston has moved a short distance in the reverse direction; the reverse motion occurring during the low or near zero g period following first stage burnout.

In addition to the substantially Z-shaped slot, the cam means further includes a latching slot extension. The latching slot extension communicates with the second integration leg of the Z-shaped slot at the end of that leg opposite the cross-over leg. Preferably, the latching slot extension is reverse angled with respect to the direction of acceleration so as to maintain switch activation against the force of the biasing spring following at least two separate acceleration pulses of sufficient force and duration in series.

Preferably, the follower pin is connected to a spring-loaded rotor mounted to the housing and concentrically disposed within a central recess in the piston. The rotor biases the follower pin to move in a direction substantially perpendicular to the direction of acceleration. Thus, the rotor effectively moves and directs the follower pin through the cross-over leg of the Z-shaped slot following completion of the first acceleration pulse and into the latching slot extension following completion of at least two multiple, separate acceleration pulses in series.

The accelerometer assembly of the present invention may also include a fixed pin mounted to the housing. The fixed pin is slidably received in the first integration leg of the Z-shaped slot so as to restrict the cam means of the piston from rotation within the chamber. Preferably the first integration leg is wider than the cross-over leg. Further, the fixed pin is dimensioned to prevent entry into the narrower cross-over leg so as to allow the piston to freely return to the initial or reset position either manually or by the biasing spring, such as during component testing.

Preferably, in order to insure smooth multiple acceleration pulse integration, the accelerometer assembly of the present invention is provided with damping means including a damping fluid and a bypass system. The bypass system includes two ports and a passage positioned within the piston and the housing forming the chamber. The ports function to reduce the damping between the first and second acceleration pulses so as to allow freer reverse movement of the piston, which occurs after decay of the first acceleration pulse, under the force of the biasing spring. Normal damping is then resumed during integration of the second acceleration pulse.

In accordance with a further aspect of the present invention, the accelerometer assembly may include a support post mounted to one of the end portions of the housing and projecting into the chamber. The movable mass, such as a piston, is provided within the chamber and receives the post in a central recess. The piston is biased or maintained in its initial or reset position by means of a spring surrounding the post. In this embodiment, as in the first, the cam is carried by the piston. The means for following the cam, such as a follower pin slidably received therein, is mounted to the post. The cam means of this embodiment also includes means for blocking the movement of the piston in response to a first acceleration pulse. During acceleration, the piston moves relative the post in opposition to the biasing spring. The blocking means of the cam and the follower pin cooperate to interrupt or block the movement of the piston toward the end of the chamber in the absence of at least two separate acceleration pulses. The switch (or switches) of the assembly is activated only after two or more pulses are sensed and the piston reaches the end of the chamber.

Still other objects of the present invention will become readily apparent to those skilled in the art from the following description wherein there is shown and described a preferred embodiment of this invention, simply by way of illustration of one of the modes best suited to carry out the invention. As it will be realized, the invention is capable of other different embodiments, and its several details are capable of modifications in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
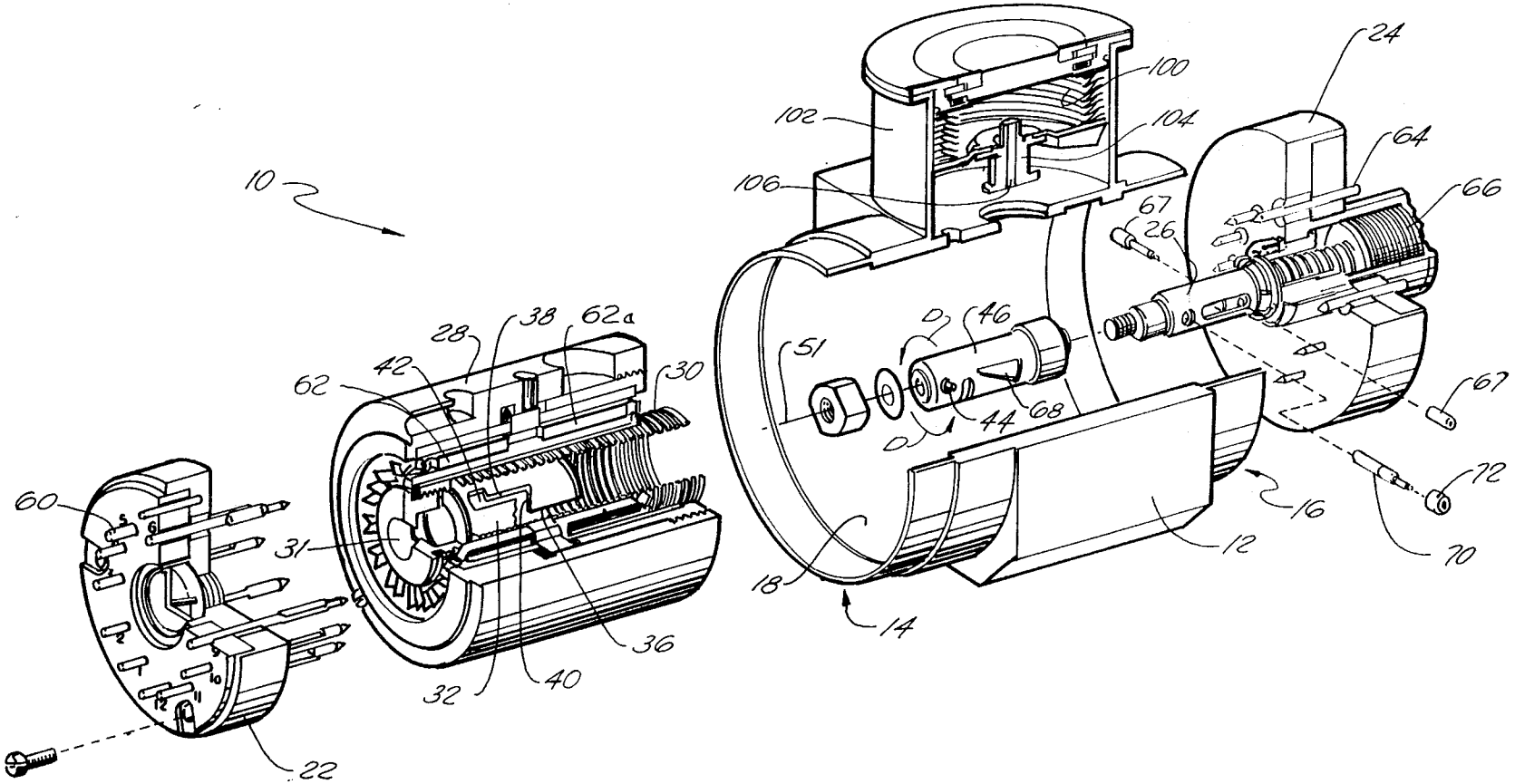
FIG. 1 is an exploded view of the accelerometer assembly of the present invention.
Figure 2:
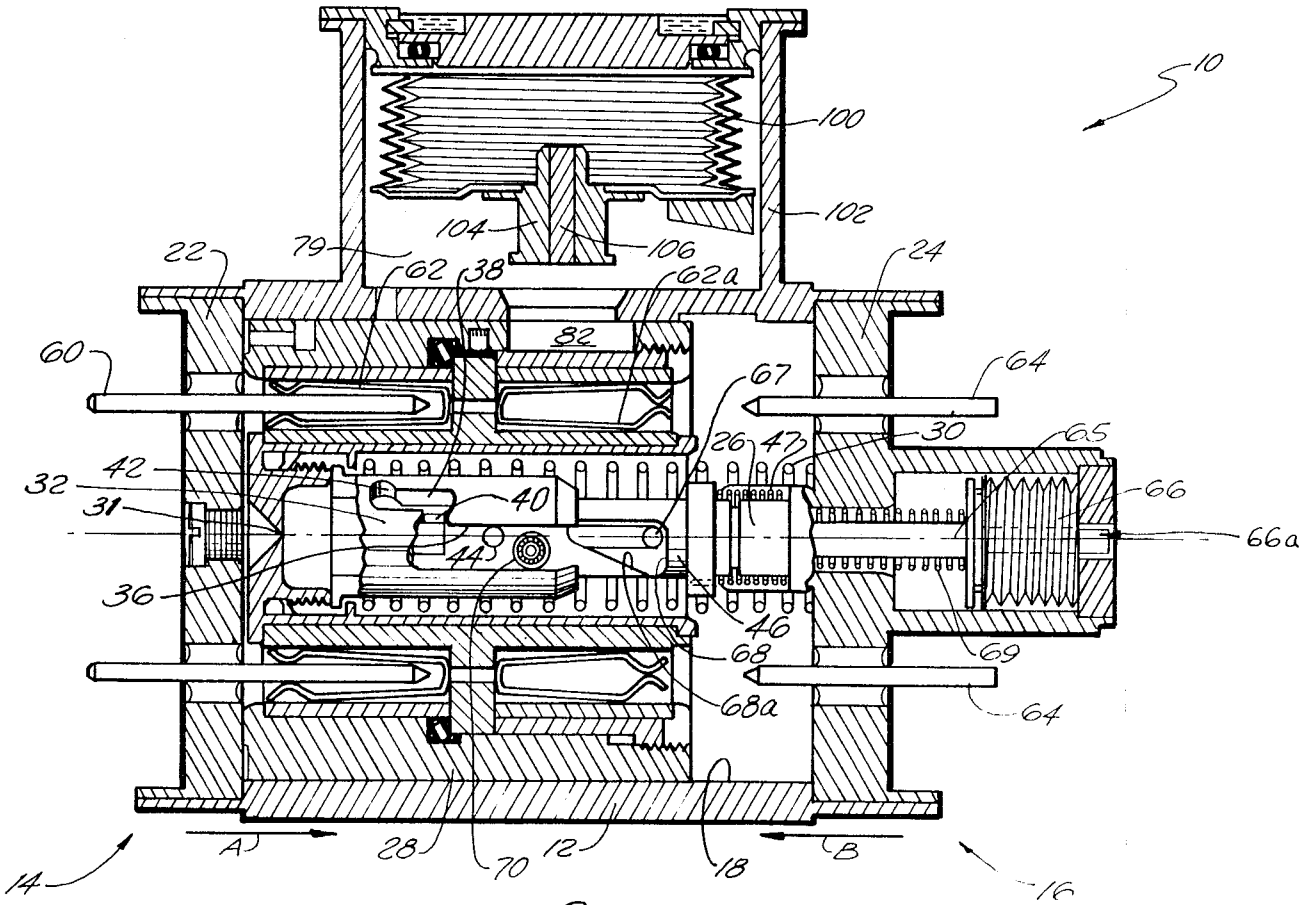
FIG. 2 is a cross-sectional view of the acceleration actuated assembly of the present invention.

Reference is now made to FIGS. 1 and 2 showing the acceleration actuated assembly 10 of the present invention for sensing or measuring the forces associated with multiple stage or pulse launch acceleration. As shown, the assembly 10 includes a housing 12 having a first end 14 and a second end 16 forming a tubular chamber 18 filled with a fluid for damping motion, such as silicone fluid. The housing 12 comprises a combination of interlocked elements; opposed end caps 22,24 and post 26, that is carried by or integral with end cap 24. Contained within the tubular chamber 18 is an inertial mass or piston assembly 28 that is longitudinally movable under acceleration or "set back" forces opposing the force provided by spring 30. As may be appreciated from viewing FIG. 2, the piston assembly 28 comprises a plurality of parts and a hollow central recess. The central recess is spaced from the outer surface of the post 26 and the spring 30 to allow relative sliding movement of the piston assembly 28 along the post.

The piston assembly 28 is held in the initial or reset position (shown in FIG. 2) by the biasing spring 30. The biasing spring 30 may, for example, preclude piston motion at accelerations up to about 3 g's. Further, piston motion is damped by the oil or silicone fluid being metered through restricted orifice 31 in the piston assembly 28 from one end of the piston to the other. Under normal conditions and with a fluid of a given viscosity, piston displacement is thus a function of the level of the input acceleration and the time over which that acceleration exists, as determined by the strength of the spring 30 and the size of the orifice 31, respectively.

As shown in FIGS. 1 and 2, the piston assembly 28 preferably carries in the central recess a cam cylinder 32 having a Z-shaped slot including a first integration leg 36, a second integration leg 38 and a cross-over leg 40 connecting the first and second integration legs. Both the first and second integration legs 36, 38, respectively, are aligned with and extend in the direction of acceleration. The cross-over leg 40, however, has a portion which is transverse and a portion which extends in an oblique direction to the direction of acceleration so as to block piston assembly movement towards the second chamber end 16 in response to a single acceleration pulse as is explained below.

The cam cylinder 32 also includes a latching slot extension 42. The latching slot extension 42 communicates with the second integration leg 38 of the Z-shaped slot at the end of the leg 38 opposite the connection with the cross-over leg 40 (i.e. the end of the leg 38 nearest the first end 14 of the chamber 18). The latching slot extension 42 serves to maintain the switch assembly 10 in the activated position once proper multi-stage firing is completed to provide a normal launch environment.

Means for following the cam 32 includes a follower pin 44 connected to a spring-loaded rotor 46 (see FIG. 1). The rotor 46 is mounted to the post 26 through torsion spring 47 and is disposed concentrically within the central recess of the piston assembly 28. The free end of the follower pin 44 extends radially outwardly through the piston assembly 28 and is slidably received within the cam slot.

During normal launch the force associated with the piston mass under acceleration of the vehicle is in the direction of arrow A of FIG. 2. As this force increases above the opposing force applied to the piston assembly 28 by the biasing spring 30 (see arrow B), the piston assembly 28 moves relative to the housing 12 and slides along the post 26 toward the second end 16 of the chamber 18. Therefore, the cam cylinder 32, carried on the piston assembly 28, slides over the follower pin 44 mounted to the housing 12 through the rotor 46 and post 26.

Also, during the first acceleration pulse, the movement is damped by the fluid passing through the orifice 31. The cam surface of first integration leg 36 is, however, longitudinally aligned with the direction of acceleration. The follower pin 44, thus, slides from the solid line position to the dashed line position at the head of the cross-over leg 40 in FIG. 3. This movement occurs only in response to a sufficient g force of acceleration overcoming the spring force, and for a sufficient length of time to offset the damping action. At the end of the first acceleration pulse, continued movement of the piston assembly 28 toward chamber end 16 is blocked by means of blocking cam surface 50 (FIG. 3) of cross-over leg 40 contacting the follower pin 44.

Figure 3:
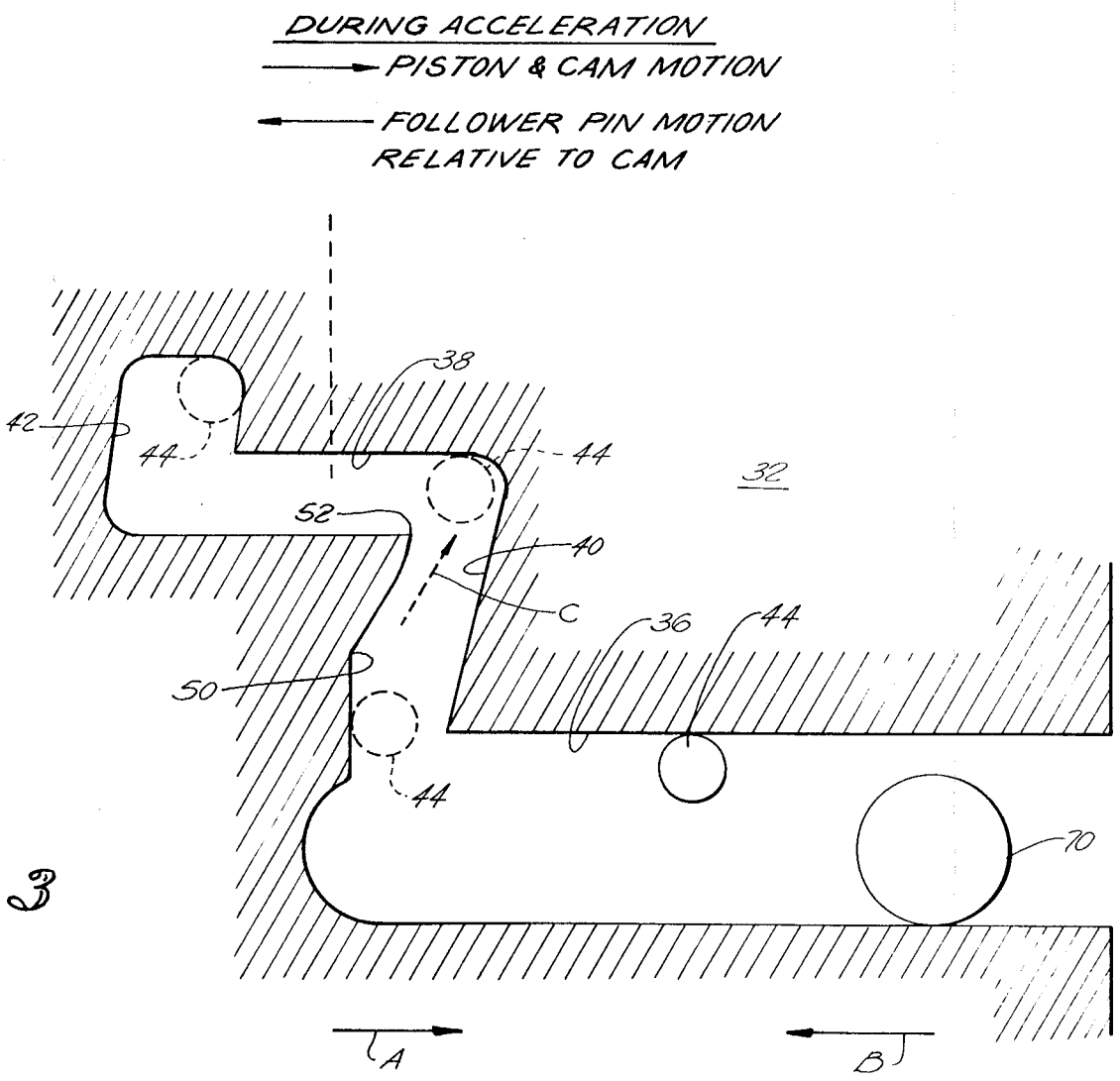
FIG. 3 is an enlarged and detailed view illustrating the movement of the following pin within the cam in response to the application of acceleration pulse.

As shown in FIG. 3, cam surface 50 of cross-over leg 40 is transverse to the direction of acceleration. Thus, the contact between cam surface 50 and follower pin 44 blocks further movement of the piston assembly 28 as long as acceleration is maintained, for example, above 2 g.

At the completion of the first acceleration pulse (i.e. first stage burnout), the piston assembly 28 is subjected to a decreasing acceleration force. When the acceleration force (in the direction of arrow A, FIG. 2) is no longer greater than the force exerted on the piston assembly 28 by the biasing spring 30 (in the direction of arrow B), the piston assembly 28 starts to move in the reverse direction toward the chamber end 14. As this occurs, the spring-loaded rotor 46 biases the follower pin 44 in the direction of arrow C oblique to the direction of acceleration (see FIG. 3), through the cross-over leg 40 toward the next dashed line position and at the head of the second integration leg 38. As should be appreciated, the rotor 46 actually rotates the follower pin 44 about an axis 51 (note arrows D in FIG. 1) running through the center of the post 26.

A protruding lip 52 extending rearwardly from the blocking cam surface 50 prevents the entry of the follower pin 44 into the second integration leg 38 in the absence of a rest phase of sufficient duration between the first and second acceleration pulses for a normal launch. If, however, the rest phase between the first and second acceleration pulses is of proper duration, the piston assembly 28 moves slightly in reverse, under action of the biasing spring 30 allowing the follower pin 44 to come to rest at the juncture of second integration leg 38 and the cross-over leg 40. Together, the biasing of the rotor 46 and the slope of the oblique portion of the cross-over leg 40 toward the second integration leg 38 insures that the follower pin 44 fully enters the head section of second integration leg (note second dashed line position in FIG. 3).

The second integration leg 38, like the first integration leg 36, is also longitudinally aligned with the direction of acceleration. This allows the integration and resultant movement of the piston assembly 28 toward the chamber end 16 in response to a second or subsequent boost phase or acceleration pulse, as previously described with respect to the first integration leg 36.

If the second or subsequent acceleration pulse is of sufficient magnitude for a sufficient length of time as would occur during a normal launch, the piston assembly 28 completes its stroke toward chamber end 16. During this time, the follower pin 44 slides along the cam surface until it reaches latching slot extension 42. Upon reaching the latching slot extension 42, the torsion spring-loaded rotor 46 biases the follower pin 44 into the next dotted line position (shown in FIG. 3).

The cam surface of latching slot extension 42 is also reverse angled, away from the direction of acceleration so as to maintain the follower pin 44 in the slot 42 and thereby, retain the piston assembly 28 in the activated position irrespective of any subsequent acceleration or de-acceleration forces.

Figure 4:
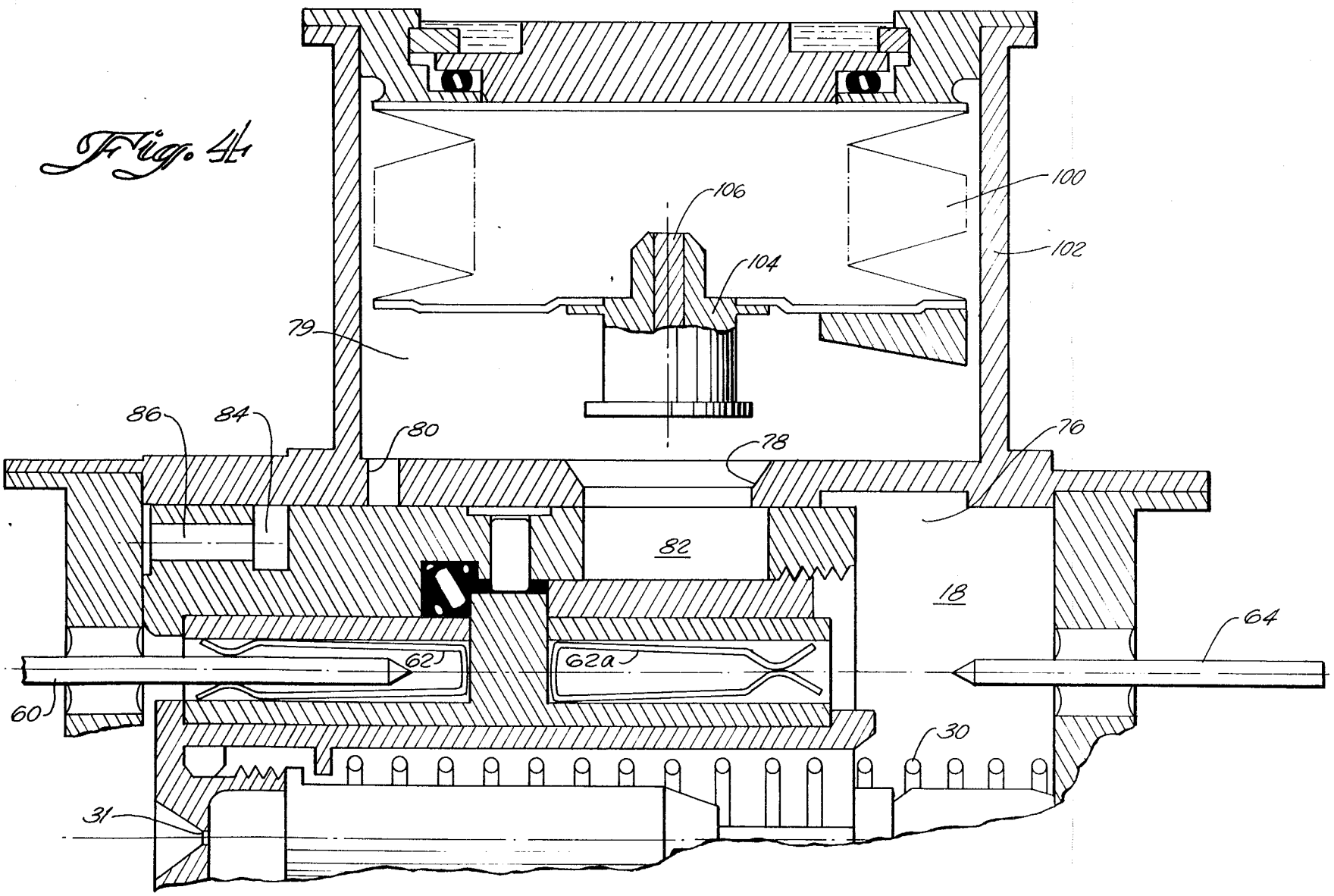
FIG. 4 is an enlarged cross-sectional view illustrating the damping system of the accelerometer assembly of the present invention.

The accelerometer assembly includes a plurality of cooperating pairs of switch terminals 60, 64 to provide the electrical switching function when the piston has reached the end of travel and follower pin 44 has entered the extension 42. The terminals 60, mounted through endcap 22 at reset end 14 engage sliding electrical contacts 62 carried by the piston assembly 28; and terminals 64, mounted through the endcap 24 at second end 16 are aligned with similar contacts **62*a* on the piston assembly 28 (FIGS. 2 and 4). As will be realized the full movement of the piston assembly 28 as described, causes the contacts 62*a* to engage the terminals 64 while the terminals 60 remain engaged with the contacts 62. This completes the electrical paths between the terminals 60, 64** and thus provides closed switches and completed circuits, one or more of which may be used in the arming of the payload of the rocket vehicle.

In the event of an accidental single-stage launch, the piston assembly 28 may advance along the post 26 to the first stage or cross-over position shown in FIG. 3. In this position, the blocking cam surface 50 cooperates with the follower pin 44 to limit the movement of the piston assembly 28 and prevent actuation. After the single-stage acceleration pulse, a pause occurs and the biasing spring 30 then forces the piston assembly 28 toward reset end 14. As the pressure is thus removed from the pin 44, it is rotated to the new position by means of the spring-loaded rotor 46. In this position the accelerometer assembly 10 is neither actuated nor reset. The electrical paths between terminals 60 and terminals 64 are not made at this point since contacts **62*a* are not engaging the terminals 64**, thus maintaining all switches open.

The accelerometer assembly 10 in this position has a high fail-safe capacity requiring a g-time pulse in excess of several g's force for several seconds that can only result from a successful second stage rocket firing. Thus, it is seen that the assembly 10 of the present invention limits or blocks the arming function of a multiple-stage missile after only being subjected to a single acceleration-time pulse, regardless of the duration of the pulse. Such operation is simply not provided by accelerometer assemblies previously known in the art. As a result, greater safety in the event of accidental firing or improper staging is achieved through the utilization of the accelerometer assembly 10 of the present invention.

The piston assembly 28 may be manually reset to the initial position shown in FIG. 2, such as may be desired during component testing. As shown, the accelerometer includes a reset rod 65 and a reset bellows 66. The reset rod 65 supports a reset pin 67 that is slidably received in a triangular camming slot 68 in rotor 46. In the reset operation, assume the piston assembly 28 is moved to the full actuated position adjacent the chamber end 16. The follower pin 44 is in latching slot extension 42 of the cam 32 (see FIG. 3). Thus, it should be recognized that the rotor 46 is rotated so that reset pin 67 is at the bottom of the triangular camming slot 68 adjacent the cam surface **68*a*. Force is applied to the end of the reset plunger 66*a* extending bellows 66 and rese rod 65 against the action of reset rod spring 69 (FIG. 2**).

As the rod is extended, reset pin 67 contacts cam surface **68*a* of camming slot 68 so as to rotate the rotor 46 against the torsion spring 47. This rotation causes the follower pin 44 to move from the latching slot extension 42 to the second integration slot 38. Upon reaching the second integration slot 38, the biasing spring 30 forces the piston assembly toward the first chamber end 14 until the follower pin 44 reaches the cross-over slot 40. As the reset rod 65 is extended further by a second and further depression of reset plunger 66*a*, the reset pin 67 continues to rotate the rotor 46 against the torsion spring 47. This rotation causes the follower pin 44 to move through the cross-over slot 40 to the first integration slot 36. When the follower pin 44 reaches the first integration slot 36, the biasing spring 30 then forces the piston assembly 28 completely to the initial or reset position shown in FIG. 2**.

It should also be noted that a fixed pin 70 on the post 26 extends into the Z-shaped cam. Specifically, the roller end 72 of the fixed pin 70 is slidably received within the first integration leg 36 of the cam 32. The fixed pin 70 functions to restrict the freely movable cam 32 from rotation within the piston assembly 28 caused by the force applied to the cam through the follower pin 44 by means of the rotor 46. Thus, the fixed pin 70 maintains the cam 32 in the proper position for cooperation with the follower pin 44. Additionally, the end 72 of the fixed pin 70 is of a considerably larger diameter than the follower pin 44 and in particular is dimensioned large enough to prevent entry into the cross-over leg 40 of the Z-shaped slot. This relationship insures that the piston assembly 28 may be reset (as discussed above) into the initial position shown in FIG. 2 without binding.

As previously indicated, fluid damping is desirable during integration of the sustained launch acceleration pulses to not only provide the time factor, but also to reduce piston oscillation for smooth piston movement and improved safety. Preferably, however, the damping is eliminated between acceleration pulses as, for example, at the pause between burnout of the first stage and firing of the second stage booster rocket. This is because the piston assembly 28 must move relatively quickly (during the short duration of the pause) so as to enable the follower pin 44 to move from the cross-over leg 40 to the second integration leg 38. Thus, when the follower pin 44 is positioned against the blocking cam surface 50 and within the cross-over leg 40, damping is eliminated by providing a pair of ports 76, 82, as shown in FIG. 4, and a passage means connected to the opposite side of the piston assembly 28. The damping fluid can now bypass the restricting orifice 31 as the fluid moves without substantial restriction from one side of the piston assembly 28 to the other.

To explain the bypass system in more detail, the chamber 12 includes a wall cavity forming the first port 76 positioned to cooperate with a port 82 in the piston. When the piston assembly 28 approaches the desired bypass position during acceleration, (i.e. when follower pin 44 is adjacent cross-over leg 40) the ports 76, 82 align to allow passage of fluid. This allows damping fluid to flow from the wall port 76 on the high pressure end of the piston assembly 28 adjacent the second end 16 into the port 82. Fluid flow then continues through the hole 78 into bypass chamber 79 and into transfer port 80 which is aligned with manifold slot or port 84.

The damping fluid then flows through the slot 84 into the passage-way 86. Thus, the damping fluid travels to the low pressure end of the piston assembly 28 adjacent first chamber end 14 through the ports 76, 82 and passage means 78–80, 84 and 86 while bypassing the restricting orifice 31 that normally provides the damping action. The resultant reduced damping allows substantially free movement of the piston, so that follower pin 44 moves through the cross-over leg 40.

The bypass oil flow described above commences before the follower pin 44 contacts blocking cam surface 50 of cross-over leg 40. After such contact, the piston must travel in reverse to allow the follower pin 44 to travel through the cross-over leg 40. The fluid flow is in the reverse direction along the same bypass path as the piston returns slightly toward the first end 14 under the force of biasing spring 30 during the pause between acceleration pulses. At this point in time, follower pin 44 is passing through the crossover leg 40 and is next located at the entry to second integration leg 38. Further motion of the piston assembly 28 due to the force of a subsequent acceleration pulse causes the leading end of the piston (the end approaching the second end 16) to move past the wall port 76 thus cutting off bypass flow and once again enabling the damping function. The damping action of the fluid passing through restricting orifice 31 continues for the remainder of the subsequent acceleration pulse integration as the pin 44 moves relative to the leg 38.

In order to prevent the accelerometer assembly 10 from becoming susceptible to actuation in the event damping fluid is lost, the accelerometer assembly is provided with a safety mechanism mounted on the side of the housing 12. As is known in the art, this mechanism includes a gas filled bellows 100 contained in bellows housing 102 which forms the bypass chamber 79. A safety detent 104 is carried at one end of the bellows 100. The safety detent 104 is sealed with a plug or core 106 of low melting point alloy. In the event the accelerometer assembly 10 becomes overheated, such as in a fire, the core 106 melts allowing the damping fluid to flow from the chamber 18 into the bellows 100. This causes the originally constricted bellows 100 to expand and move safety detent 104 through hole 78 in the housing 12 and into the port 82 in the piston assembly 28. The piston assembly 28 is thus blocked from moving and the accelerometer is safely disabled.

In summary, numerous benefits have been described which result from employing the accelerometer assembly 10 of the present invention. The cam 32, including the Z-shaped slot and latching slot extension 42, cooperates with the follower pin 44 and the spring-loaded rotor 46 to provide an integrating accelerometer that blocks activation if subjected to only a single acceleration-time pulse, regardless of the duration of the pulse. In other words, the accelerometer assembly 10 provides for activation only in response to multi-stage acceleration pulses, and can be used for example to activate a switch to arm the payload of a multi-stage rocket vehicle.

The accelerometer assembly 10 reliably responds only to repeated acceleration pulses in the same direction with low or near zero acceleration phases between the pulses. Thus, the present switch provides improved safety over prior art switches that activate as long as the magnitude of the acceleration is of sufficient value for a sufficient length of time regardless of the number of pulses or stages involved.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

I claim:

1. An accelerometer assembly for use in activating a switch or the like responding to multiple acceleration pulses in series, comprising:

a housing forming a chamber having a first and second end;

a mass slidably disposed in said chamber and movable during acceleration from said first end toward said second end;

means for biasing said movable mass toward a reset position adjacent said first end;

means for damping the movement of said mass in said chamber;

cam and follower means carried by said movable mass and said housing for relative movement in response to said acceleration, said cam and follower means including means for temporarily blocking the mass movement toward said second end after a first acceleration pulse;

said cam and follower means cooperating together to allow continued movement toward said second end and switch activation in response to at least a second separate acceleration pulse in series with the first.

2. The accelerometer disclosed in claim 1, wherein said cam means comprises a substantially Z-shaped slot.

3. The accelerometer disclosed in claim 2, wherein said Z-shaped slot includes;

a first integration leg substantially longitudinally aligned with the direction of acceleration to allow movement of said mass toward said second end during a first acceleration pulse;

a second integration leg substantially longitudinally aligned with the direction of acceleration to allow further movement of said mass toward said second end during at least a second acceleration pulse; and a cross-over leg for connecting said first and second integration legs together, said cross-over leg being transverse with respect to the direction of acceleration and serving as a means for blocking the movement of said mass and preventing switch activation in response to a first acceleration pulse only.

4. The accelerometer disclosed in claim 3, wherein said cross-over leg includes a rearwardly protruding lip as a means for further blocking mass movement during the first acceleration pulse.

5. The accelerometer disclosed in claim 3, wherein said cam means further includes a latching slot extension, said latching slot extension communicating with said second integration leg of said Z-shaped slot at the end opposite said cross-over leg, said latching slot being reverse angled with respect to the direction of acceleration so as to maintain switch activation following at least two separate acceleration pulses in series.

6. The accelerometer disclosed in claim 1, wherein said follower means includes a follower pin slidably received in said cam means.

7. The accelerometer disclosed in claim 5, wherein said mass includes a central recess and said follower means includes a follower pin slidably received in said Z-shaped slot.

8. The accelerometer disclosed in claim 7, wherein said cross-over leg includes a rearwardly protruding lip such that the mass and cam must move slightly in reverse toward the reset position before the follower pin enters the second integration leg.

9. The accelerometer disclosed in claim 8, wherein said follower pin is connected to a springloaded rotor concentrically disposed within said central recess of said mass and mounted to said housing, said rotor biasing said pin to move in a direction substantially perpendicular to the direction of acceleration so that said pin moves through said cross-over leg of said Z-shaped slot following completion of the first acceleration pulse and into said latching slot extension following completion of at least two separate acceleration pulses in series.

10. The accelerometer disclosed in claim 3, wherein is further provided a fixed pin mounted to said housing, said fixed pin being slidably received in said first integration leg of said Z-shaped slot so as to restrict said cam means from rotation.

11. The accelerometer disclosed in claim 10, wherein said first integration leg is wider than said cross-over leg and said fixed pin is dimensioned to prevent entry into said cross-over leg during reset of said mass toward said first end.

12. The accelerometer disclosed in claim 1, wherein said damping means includes a damping fluid and a restricted flow orifice connecting the opposite ends of the chamber through which the fluid flows during damped movement of said mass during said first acceleration pulse, and first and second bypass ports in said housing and said mass, respectively, said ports being aligned only in the position of said mass between said first pulse and said second pulse, and passage means connecting said aligned ports to the opposite ends of said chamber, whereby to allow relatively free movement of said mass between said pulses.

13. An accelerometer assembly for use in activating a switch or the like responding to multiple acceleration pulses in series, comprising:

a housing including end portions forming a chamber;

a post mounted to an end portion and projecting into said chamber;

a movable mass including a central recess for receiving said post;

means for biasing said movable mass toward a reset position;

means for damping the movement of said mass in said chamber;

cam means carried by said movable mass, said cam means including means for temporarily blocking mass movement in response to a first acceleration pulse; and means for following said cam means, said following means being mounted on said post;

said mass being movable along said post in opposition to said biasing means during acceleration and said cam and following means cooperating together to allow continued movement and switch activation only in response to a series of at least two separate acceleration pulses.

14. The accelerometer disclosed in claim 13, wherein said cam means includes a substantially Z-shaped slot and a latching slot extension, said Z-shaped slot including a first integration leg substantially longitudinally aligned with the direction of acceleration to allow movement of said mass in opposition to said biasing means during a first acceleration pulse, a second integration leg substantially longitudinally aligned with the direction of acceleration to allow further movement of said mass in opposition to said biasing means during at least a second acceleration pulse, and a cross-over leg connecting said first and second integration legs together, said cross-over leg being transverse with respect to the direction of acceleration and serving as a means for limiting the movement of said mass and preventing switch activation in response to said first acceleration pulse; and said latching slot extension communicating with said second integration leg of said Z-shaped slot at the end of said second integration leg opposite said cross-over leg, said latching slot being reverse angled with respect to the direction of acceleration so as to maintain switch activation following at least two separate acceleration pulses in series.

15. The accelerometer disclosed in claim 14, wherein said following means includes a follower pin received in said cam means.

16. The accelerometer disclosed in claim 15, wherein said follower pin is connected to a spring-loaded rotor mounted to said post, said rotor biasing said pin to follow said cam means in a direction substantially perpendicular to the direction of acceleration so that said pin moves through said cross-over leg of said Z-shaped slot following completion of the first acceleration pulse and into said latching slot extension following completion of at least two separate acceleration pulses in series.

17. The accelerometer disclosed in claim 16, wherein is further provided a fixed pin mounted to said post, said fixed pin being slidably received in said first integration leg of said Z-shaped slot so as to restrict said cam means from rotation.

18. The accelerometer disclosed in claim 13, wherein said damping means includes a damping fluid and a restricted flow orifice connecting the opposite ends of the chamber through which the fluid flows during damped movement of said mass during said first acceleration pulse, and first and second bypass ports in said housing and said mass, respectively, said ports being aligned only in the position of said mass between said first pulse and said second pulse, and passage means connecting said aligned ports to the opposite ends of said chamber, whereby to allow relatively free movement of said mass between said pulses.

* * * * *